US010410808B2

(12) United States Patent
Yuan et al.

(10) Patent No.: US 10,410,808 B2
(45) Date of Patent: Sep. 10, 2019

(54) KEY ASSEMBLIES, KEYBOARDS AND METHODS FOR PROVIDING A KEY ASSEMBLY

(71) Applicants: RAZER (ASIA-PACIFIC) PTE. LTD., Singapore (SG); HUIZHOU GREETECH ELECTRONICS CO., LTD., Huizhou, Guangdong (CN)

(72) Inventors: Shangping Yuan, Huizhou (CN); Kok Kiong Low, Singapore (SG)

(73) Assignee: RAZER (ASIA-PACIFIC) PTE. LTD., Singapore (SG)

( * ) Notice: Subject to any disclaimer, the term of this patent is extended or adjusted under 35 U.S.C. 154(b) by 0 days.

(21) Appl. No.: 15/751,748

(22) PCT Filed: Aug. 12, 2016

(86) PCT No.: PCT/SG2016/050389
§ 371 (c)(1),
(2) Date: Feb. 9, 2018

(87) PCT Pub. No.: WO2017/026946
PCT Pub. Date: Feb. 16, 2017

(65) Prior Publication Data

US 2018/0240622 A1 Aug. 23, 2018

(30) Foreign Application Priority Data

Aug. 13, 2015 (CN) ..... 2015 2 0610704 U

(51) Int. Cl.
*H01H 13/84* (2006.01)
*H01H 13/705* (2006.01)
(Continued)

(52) U.S. Cl.
CPC ..... *H01H 13/84* (2013.01); *H01H 13/14* (2013.01); *H01H 13/20* (2013.01);
(Continued)

(58) Field of Classification Search
CPC ..... H01H 13/84; H01H 13/20; H01H 13/702; H01H 13/14
(Continued)

(56) References Cited

U.S. PATENT DOCUMENTS 5,015,811 A * 5/1991 Moriyama ..... H01H 13/50 200/308
5,525,979 A 6/1996 Engle et al.
(Continued)

FOREIGN PATENT DOCUMENTS

CN 2315652 Y 4/1999
CN 201904255 U 7/2011
(Continued)

OTHER PUBLICATIONS

International Search Report and Written Opinion, dated Dec. 8, 2016, for the corresponding International Application No. PCT/SG2016/050389 in 9 pages.
(Continued)

*Primary Examiner* — Edwin A. Leon
*Assistant Examiner* — Iman Malakooti
(74) *Attorney, Agent, or Firm* — Polsinelli PC

(57) ABSTRACT

According to various embodiments, there is provided a key assembly including a housing including a sliding groove on an inner surface of the housing and further including a contact surface above the sliding groove; a plunger at least partially fitted into the housing, the plunger including a protrusion; a sound producing member provided at least partially in the sliding groove, the sound producing member configured to produce sound by impacting the contact surface; wherein the sound producing member includes a connecting portion obliquely extending to an abutting portion, the abutting portion arranged below the protrusion; wherein the plunger is displaceable downwards to deform
(Continued)

the connecting portion using the protrusion, the deformed connecting portion being reboundable to cause impact the sound producing member to impact the contact surface.

17 Claims, 4 Drawing Sheets

(51) Int. Cl.
*H01H 13/14* (2006.01)
*H01H 13/20* (2006.01)
*H01H 13/702* (2006.01)

(52) U.S. Cl.
CPC ..... *H01H 13/702* (2013.01); *H01H 13/705* (2013.01); *H01H 2215/03* (2013.01); *H01H 2221/026* (2013.01); *H01H 2223/03* (2013.01); *H01H 2233/07* (2013.01)

(58) Field of Classification Search
USPC ..... 200/5 R
See application file for complete search history.

(56) References Cited

U.S. PATENT DOCUMENTS 5,710,397 A * 1/1998 Liao ..... H01H 13/705 200/345
2008/0223704 A1 9/2008 Li
2010/0307903 A1* 12/2010 Chien ..... H01H 13/705 200/345

FOREIGN PATENT DOCUMENTS

| | | | |
|---|---|---|---|
| CN | 203445036 | U | 2/2014 |
| CN | 204270946 | U | 4/2015 |
| EP | 0353900 | A1 | 2/1990 |
| GB | 2282704 | A | 4/1995 |
| JP | S6123238 | U | 2/1986 |
| JP | 2012-138254 | A | 7/2012 |
| TW | 541552 | B | 7/2003 |
| TW | 1475587 | B | 3/2015 |

OTHER PUBLICATIONS

Membrane Keyboard from online at https://en.wikipedia.org/w/index.php?title=Membrane_keyboard&oldid=815334808 in 3 pages last edited on Dec. 14, 2017.
Extended European Search Report dated Jul. 6, 2018, 8 pages, for the corresponding European Patent Application No. 16835547.7.
Office Action (including translation thereof) dated Mar. 1, 2019, 15 pages, for the corresponding Chinese Patent Application No. 201680052723.3.
Office Action (including translation thereof) dated Jun. 27, 2019, in 24 total pages, for the corresponding Taiwanese Patent Application No. 105126013.

* cited by examiner

KEY ASSEMBLIES, KEYBOARDS AND METHODS FOR PROVIDING A KEY ASSEMBLY

CROSS-REFERENCE TO RELATED APPLICATIONS

This application claims the benefit of Chinese utility model application number CN 201520610704.0 filed 13 Aug. 2015, the entire contents of which are incorporated herein by reference for all purposes.

TECHNICAL FIELD

The present invention relates to key assemblies, keyboards and methods for providing a key assembly.

BACKGROUND

A switch may include a push button or a key. The button or key may drive an actuator structure, so as to connect or interrupt a connection between a movable contact and a stationary contact, thereby realizing switching of a circuit. The switch may be structurally simple. The switch may be applied to a broad range of applications and may be a master electrical device. With the development of science and technology, different types of switching apparatuses such as optical-sensing switches, micro switches, push-button switches, and thermo-sensing switches have been developed in recent years to suit different intended uses and functions. For electronic devices or computer peripherals such as keyboards for personal computers, laptops or other low-profile input devices, membrane-based switches are widely used in the key assemblies. The structure of membrane keyboards may allow for a minimal travel distance of the keys on the keyboard. While some variants of the membrane keyboard may be able to offer a tactile feel when the keys are pressed, membrane keyboards are still not able to offer audible response, i.e. the "click sound" that mechanical keyboards provide. The tactile feedback from a membrane keyboard is also generally not as satisfactory as the tactile feedback from a mechanical keyboard. The ON and OFF states of the membrane keyboard may be known to a user generally only via visual effects. On the other hand, mechanical switches such as those used in mechanical keyboards, are still widely used in a variety of simple switches due to their ability to provide accurate energy conversion control. However, mechanical switches may suffer from elastic fatigue after prolonged usage.

As such, there is a need for a new type of key assembly that may overcome the shortcomings of the existing key assemblies such as the membrane-switch key assembly and the mechanical-switch key assembly.

SUMMARY

According to various embodiments, there may be provided a key assembly including a housing including a sliding groove on an inner surface of the housing and further including a contact surface above the sliding groove; a plunger at least partially fitted into the housing, the plunger including a protrusion; a sound producing member provided at least partially in the sliding groove, the sound producing member configured to produce sound by impacting the contact surface; wherein the sound producing member includes a connecting portion obliquely extending to an abutting portion, the abutting portion arranged below the protrusion; wherein the plunger is displaceable downwards to deform the connecting portion using the protrusion; the deformed connecting portion being reboundable to cause the sound producing member to impact the contact surface.

According to various embodiments, there may be provided a method for providing a key assembly, the method including: providing a housing, the housing including a sliding groove on an inner surface of the housing and further including a contact surface above the sliding groove; fitting a plunger at least partially into the housing, the plunger including a protrusion; providing a sound producing member at least partially in the sliding groove, the sound producing member configured to produce sound by impacting the contact surface; wherein the sound producing member includes a connecting portion obliquely extending to an abutting portion, the abutting portion arranged below the protrusion; wherein the plunger is displaceable downwards to deform the connecting portion using the protrusion; the deformed connecting portion being reboundable to cause the sound producing member to impact the contact surface.

According to various embodiments, there may be provided a keyboard including a plurality of key assemblies, wherein each key assembly of the plurality of key assemblies includes: a housing including a sliding groove on an inner surface of the housing and further including a contact surface above the sliding groove; a plunger at least partially fitted into the housing, the plunger including a protrusion; a sound producing member provided at least partially in the sliding groove, the sound producing member configured to produce sound by impacting the contact surface; wherein the sound producing member includes a connecting portion obliquely extending to an abutting portion, the abutting portion arranged below the protrusion; wherein the plunger is displaceable downwards to deform the connecting portion using the protrusion; the deformed connecting portion being reboundable to cause the sound producing member to impact the contact surface.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DESCRIPTION

Figure 1:
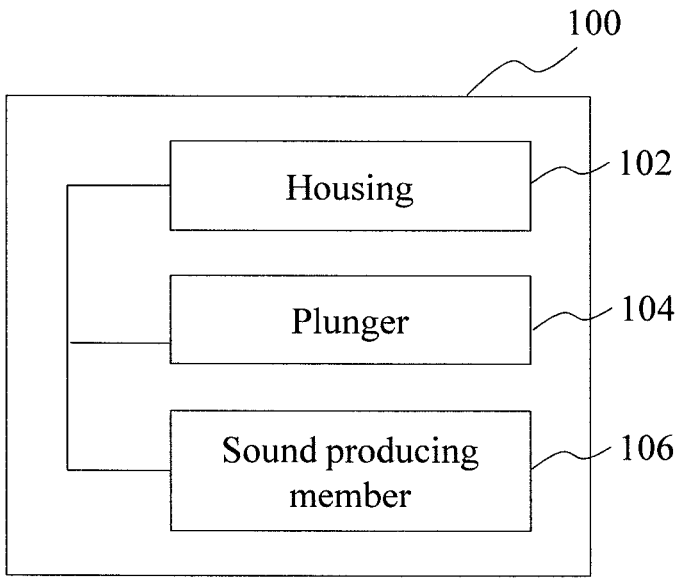
FIG. 1 shows a conceptual diagram of a key assembly according to various embodiments.

Embodiments described below in context of the key assemblies and keyboards are analogously valid for the respective methods, and vice versa. Furthermore, it will be understood that the embodiments described below may be combined, for example, a part of one embodiment may be combined with a part of another embodiment.

It will be understood that any property described herein for a specific key assembly may also hold for any key assembly described herein. It will be understood that any property described herein for a specific method may also hold for any method described herein. It will be understood that any property described herein for a specific keyboard may also hold for any keyboard described herein. Furthermore, it will be understood that for any key assembly, keyboard or method described herein, not necessarily all the components or steps described must be enclosed in the key assembly, keyboard or method, but only some (but not all) components or steps may be enclosed.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The term "coupled" (or "connected") herein may be understood as electrically coupled or as mechanically coupled, for example attached or fixed, or just in contact without any fixation, and it will be understood that both direct coupling or indirect coupling (in other words: coupling without direct contact) may be provided.

The reference to any prior art in this specification is not, and should not be taken as an acknowledgement or any form of suggestion that the referenced prior art forms part of the common general knowledge in Australia (or any other country).

In order that the invention may be readily understood and put into practical effect, particular embodiments will now be described by way of examples and not limitations, and with reference to the figures.

A switch may include a push button or a key. The button or key may drive an actuator structure, so as to connect or interrupt a connection between a movable contact and a stationary contact, thereby realizing switching of a circuit. The switch may be structurally simple. The switch may be applied to a broad range of applications and may be a master electrical device. With the development of science and technology, different types of switching apparatuses such as optical-sensing switches, micro switches, push-button switches, and thermo-sensing switches have been developed in recent years to suit different intended uses and functions. For electronic devices or computer peripherals such as keyboards for personal computers, laptops or other low-profile input devices, membrane-based switches are widely used in the key assemblies. The structure of membrane keyboards may allow for a minimal travel distance of the keys on the keyboard. While some variants of the membrane keyboard may be able to offer a tactile feel when the keys are pressed, membrane keyboards still not offer the audible response, i.e. the "click sound" that mechanical keyboards provide. The ON and OFF states of the membrane keyboard may be known to a user only via visual effects. On the other hand, mechanical switches such as those used in mechanical keyboards, are still widely used in a variety of simple switches due to their ability to provide accurate energy conversion control. However, mechanical switches may suffer from elastic fatigue after prolonged usage.

In the context of various embodiments, "key assembly" may be but is not limited to being interchangeably referred to as a "key release structure".

In the context of various embodiments, "plunger" may be but is not limited to being interchangeably referred to as a "guide plunger" or a "pressing block".

In the context of various embodiments, "housing" may be but is not limited to being interchangeably referred to as a "lower base block".

In the context of various embodiments, "sound producing member" may be but is not limited to being interchangeably referred to as a "sound producing plate".

In the context of various embodiments, "key cap" may be but is not limited to being interchangeably referred to as a "stopper portion".

In the context of various embodiments, "protrusion" may be but is not limited to being interchangeably referred to as a "protruding rib".

FIG. 1 shows a conceptual diagram of a key assembly 100 according to various embodiments. The key assembly 100 may include a housing 102, the housing 102 including a sliding groove on an inner surface of the housing 102 and further including a contact surface above the sliding groove. The key assembly 100 may further include a plunger 104 at least partially fitted into the housing. The plunger 104 may include a protrusion. The key assembly 100 may further include a sound producing member 106 provided at least partially in the sliding groove. The sound producing member 106 may be configured to produce sound by impacting the contact surface. The sound producing member 106 may include a connecting portion obliquely extending to an abutting portion. The abutting portion may be arranged below the protrusion. The abutting portion may also abut the plunger 104. The plunger 104 may be displaceable downwards to deform the connecting portion using the protrusion. The deformed connecting portion may be reboundable, to cause the sound producing member 106 to impact the contact surface.

In other words, according to various embodiments, a key assembly 100 may include a housing 102, a plunger 104 and a sound producing member 106. The housing 102 may include a sliding groove. The sliding groove may be provided on an inner surface of the housing 102. The housing 102 may further include a contact surface above the sliding groove. The plunger 104 may be at least partially fitted into the housing 102. For example, the housing 102 may have a hollow core formed therein and the plunger 104 may be arranged in the hollow core. In other words, the housing 102 may encircle, or at least partially surround the plunger 104. The plunger 104 may include a protrusion. The protrusion may extend obliquely out from an outer surface of the plunger 104. The sound producing member 106 may be arranged at least partially in the sliding groove. The sound producing member 106 may produce sound by impacting the contact surface. In other words, an impact between the sound producing member 106 and the contact surface generates an audible response. The sound producing member 106 may include a connecting portion. The connecting portion may obliquely extend to an abutting portion arranged below the protrusion. The sound producing member 106 may include a main body that is at least substantially aligned or parallel to the inner surface of the housing 102. The connecting portion may be arranged slanted relative to the main body, or in other words, at an acute angle relative to the main body. The abutting portion may abut the plunger 104. The plunger 104 may be displaceable downwards, such that the protrusion deforms the connecting portion. An upward momentum may be generated when the deformed connecting portion rebounds. The deformed connecting portion may resume its original position, in other words, the sound producing member 106 may resume its original shape. The deformed connecting portion may rebound when the downward pressure exerted on it by the protrusion is suddenly removed. For example, the deformed connecting portion may rebound when the protrusion moves past the abutting portion. Alternatively, the deformed connecting portion may rebound when the plunger 104 moves back to its default position, i.e. is displaced upwards, for example, by being pushed upwards by an elastic component underneath the plunger 104. The sound producing member 106 may impact the contact surface when the upward momentum is generated.

Figure 2:
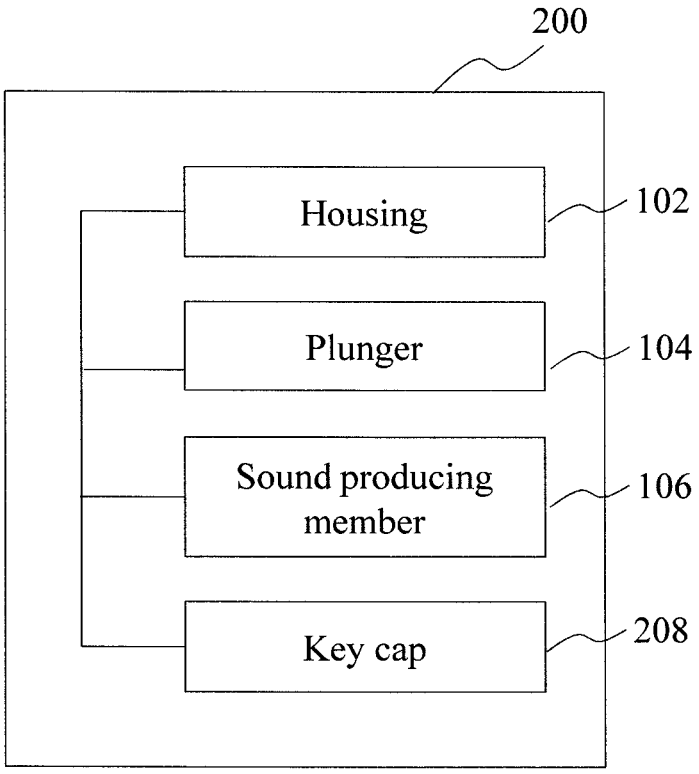
FIG. 2 shows a conceptual diagram of a key assembly according to various embodiments

FIG. 2 shows a conceptual diagram of a key assembly 200 according to various embodiments. The key assembly 200 may be similar to the key assembly 100, in that it may include a housing 102, a plunger 104 and a sound producing member 106. The key assembly 200 may further include a key cap 208. The key cap 208 may be provided over the plunger 104. The perimeter of the key cap 208 may be greater than a perimeter of a top portion of the housing 102. The key cap 208 may be coupled to the plunger 104 such that when the key cap 208 is pushed down by an external force, the plunger 104 displaces downwards. When the plunger is fully depressed, the key cap 208 may fully cover the top portion of the housing 102. The key cap 208 may prevent dust from entering inside the key assembly 200. The key cap 208 may have a character, letter or picture printed on it, or may have a texture or Braille code embossed onto it. The print or the texture on the key cap 208 may indicate the function of the key.

Figure 3:
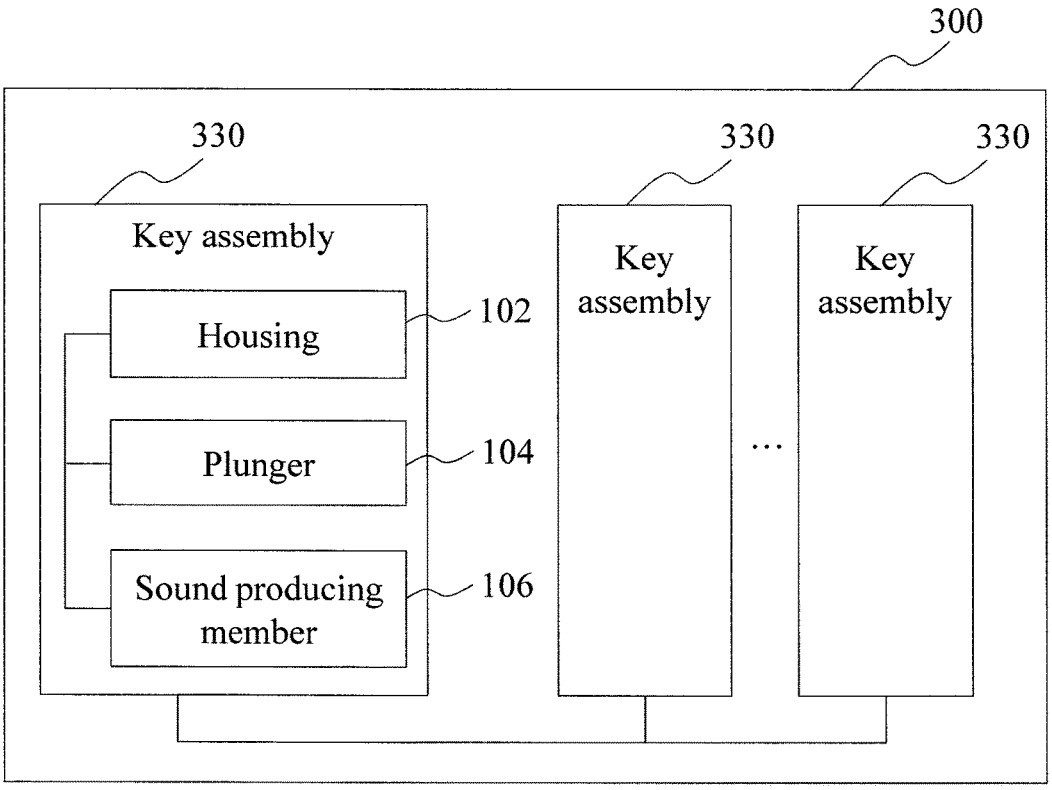
FIG. 3 shows a conceptual diagram of a keyboard according to various embodiments.

FIG. 3 shows a conceptual diagram of a keyboard 300 according to various embodiments. The keyboard 300 may include a plurality of key assemblies 330. The key assembly 330 may include the key assembly 100 or the key assembly 200. The keyboard 300 may be a membrane keyboard, in other words, it may include a membrane switch sheet arranged under the plurality of key assemblies 330. The membrane switch sheet may include a matrix circuitry printed onto a flexible sheet, such that each key assembly rests over a respective cell of the matrix circuitry. The membrane switch sheet may include a plurality of layers. When pressure is exerted on a top layer of the plurality of layers, the top layer may be pressed against an underlying layer, to bridge the gap in the matrix circuitry. In other words, when the top layer is pressed, the state of the key may be ON. When the pressure is relieved, the state of the key may be OFF. The keyboard 300 may further include a rubber dome sheet placed above the membrane switch sheet. The rubber dome sheet may include a plurality of rubber domes. Each rubber dome may correspond to a single key and may be coupled to a respective key assembly 330. Each key assembly 330 of the plurality of key assemblies 330 may include a housing 102, a plunger 104 and a sound producing member 106. The housing 102 may include a sliding groove on an inner surface of the housing 102, and may further include a contact surface above the sliding groove. The plunger 104 may include a protrusion. The plunger 104 may be at least partially fitted into the housing 102. The sound producing member 106 may be provided at least partially in the sliding groove. The sound producing member 106 may include a connecting portion obliquely extending to an abutting portion, the abutting portion arranged below the protrusion and abutting the plunger 104. The plunger 104 may be displaceable downwards. When an external force is exerted on the plunger 104, the plunger 104 may be pushed down, i.e. the key may be displaced through the travel distance, and the coupled rubber dome may collapse so that pressure is exerted on the underlying membrane switch sheet to turn on the switch. When the plunger 104 is displaced downwards, the plunger 104 may deform the connecting portion of the sound producing member 106 using the protrusion. When the plunger 104 moves down such that the protrusion moves past the abutting portion, the deformed connecting portion may rebound, thereby generating an upward momentum. The upward momentum may hurl the sound producing member 106 upwards to impact the contact surface, thereby generating a sound. The sound may be similar to the "click" sound generated by a mechanical keyboard. When the external force is removed, the collapsed rubber dome may resume its default shape by virtue of its elastic characteristic, thereby pushing the plunger 104 upwards back to its default position. The interaction between the protrusion and the sound producing member 106 may provide stiffness to the actuation of the key assembly, thereby providing a tactile feel similar to that of a mechanical keyboard.

Figure 4:
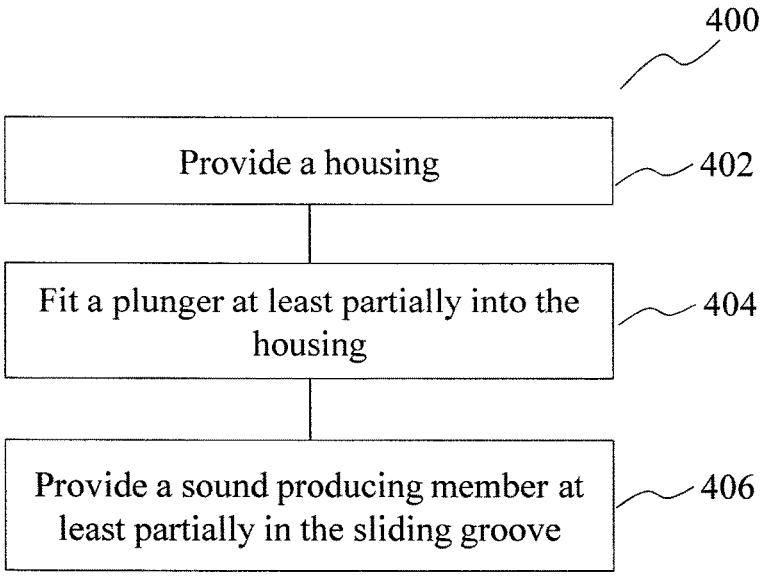
FIG. 4 shows a flow diagram showing a method for providing a key assembly according to various embodiments.

FIG. 4 shows a flow diagram 400, showing a method for providing a key assembly according to various embodiments. The method may include a first process 402, in which a housing may be provided. The housing may include a sliding groove on an inner surface of the housing and may further include a contact surface above the sliding groove. The method may further include a second process 404, in which a plunger may be fitted at least partially into the housing. The plunger may include a protrusion. The method may further include a third process 406, in which a sound producing member is provided at least partially in the sliding groove. The sound producing member may be configured to produce sound by impacting the contact surface. The sound producing member may include a connecting portion obliquely extending to an abutting portion, the abutting portion arranged below the protrusion. The plunger may be displaceable downwards to deform the connecting portion using the protrusion. The deformed connecting portion may be reboundable to cause the sound producing member to impact the contact surface.

According to various embodiments, a key structure, also referred herein as a key assembly, a push-button structure or a key switch, may be provided. The key structure may include a key release structure. The key release structure may provide an audible response or a sound, for example, in response to the key being depressed. In other words, the audible response may be indicative of a state of the key, for example, a sound may be provided when the key is depressed, indicating that the switch is ON. When the key is released, there may be no sound, indicating that the switch is OFF. The key assembly may be used in digital equipments, information technology devices or computer peripherals, for example, on a keyboard. The key assembly may be installed in a membrane keyboard, so as to provide the audible sounds, mimicking the sound effect of mechanical keyboards. The key assembly may also provide an obvious tactile bump feel in the key pressing process.

According to various embodiments, a key structure may be provided. The key structure may include a membrane switch for keyboards or key-related input devices. The key structure may include a mechanical assembly for operating the membrane switch. The key structure may be particularly useful for low-profile keyboards or key-related input devices. A sound producing member, for example, a leaf spring, may be arranged to contact a protruding rib located at a side of a guide plunger, also referred herein as a pressing block, of a key cap. The sound producing member may be arranged in a manner such that when the guide plunger travels downwards on actuation of the key cap by a user, the protruding rib may engage with the sound producing member causing the sound producing member to deform and to accelerate in the opposing direction of the guide plunger to contact with an impact surface of the housing, thereby producing the click sound that is characteristic of a mechanical key switch.

According to various embodiments, a key release structure with audible response may be provided. The key release structure may include a lower base body and a pressing block. The pressing block may be interconnected with, and onto the lower base body. The lower base body may be provided with a first sliding groove configured for upward and downward sliding movement of the pressing block. The key assembly may include a sound producing plate within the lower base body. The sound producing plate may be provided at a middle portion of the inner side of the first sliding groove. One of the inner sides of the lower base body may be provided with a second sliding groove, wherein the second sliding groove may be provided with a space configured for upward and downward sliding movement of the sound producing plate for a predetermined distance within the second gliding groove. The sound producing plate may include a main body arranged in the second sliding groove. The main body may bend inwards and extend to a connecting portion, wherein the connecting portion may bend obliquely downward and extend to an abutting portion, wherein the abutting portion may bend outward and extend to an edge portion. An abutting surface for abutting and contacting the abutting portion may be provided at a side of the pressing block corresponding to the sound producing plate. A middle portion of the abutting surface may protrude downward to form a protruding rib. A protruding feature may be provided at an upper portion of the inner side of the first sliding groove. An axially extending and protruding stopper portion may be provided at a tip of the pressing block, wherein the perimeter of the stopper portion is greater than the perimeter of a top portion of the lower base body. When the pressing block slides downward under an external force, the protruding rib may press the abutting portion so that the connecting portion is deformed. When the pressing block slides across the top point of the connecting portion, the connecting portion may rebound and may produce an upward momentum, so that the sound producing plate may generate an upward speed and may bump with the protruding feature of the lower base body to produce sound, thereby determining the ON and OFF states of the key and providing an obvious tactile bump feel.

According to various embodiments, the key assembly may be a low-profile mechanical membrane key switch.

According to various embodiments, the keyboard may be a membrane keyboard. The membrane keyboard may provide a similar user experience as a mechanical keyboard, in that the membrane keyboard may provide an audible "clicking" sound when the keys are pressed and may also provide the tactile feel of a mechanical keyboard.

Figure 5:
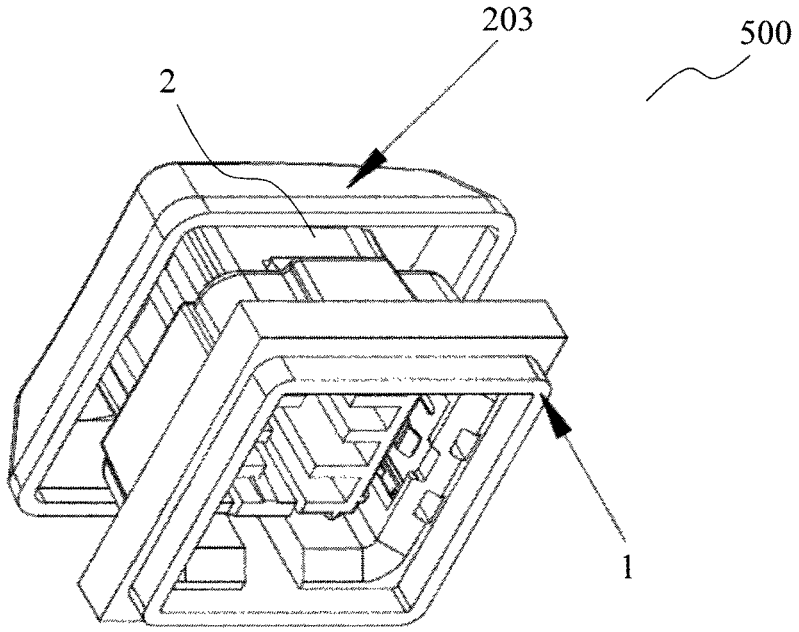
FIG. 5 shows a perspective view of a key assembly according to various embodiments.

FIG. 5 shows a perspective view of a key assembly 500 according to various embodiments. The key assembly 500 may be the key assembly 100 or the key assembly 200. The key assembly 500 may include a housing 1. The housing 1 may be similar to, or identical to the housing 102. The housing 1 may also be referred herein as a lower base block. The key assembly 500 may also include a plunger 2. The plunger 2 may be similar to, or identical to the plunger 104. The plunger 2 may also be referred herein as a pressing block or a slider. The plunger 2 may be interconnected with and onto the housing 1. In other words, the plunger 2 may be at least partially fitted into the housing 1 or slidably partially inserted into the housing 1. The key assembly 500 may further include a key cap 203 arranged over the plunger 2. The key cap 203 may be coupled to the plunger 2 such that when a user presses the key cap 203, the plunger 2 is displaced downwards. The key cap 203 may be similar to, or identical to the key cap 208.

Figure 6:
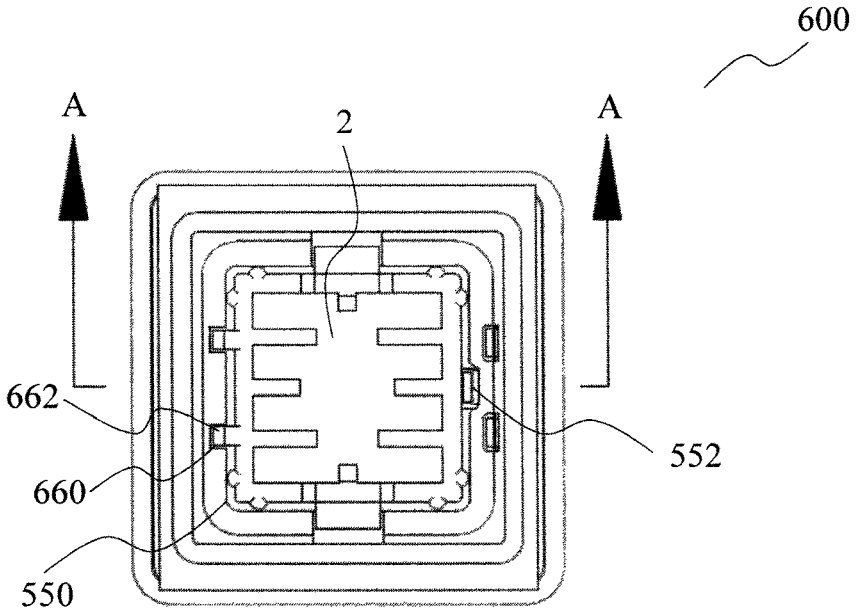
FIG. 6 shows a bottom view of the key assembly of FIG. 5.

FIG. 6 shows a bottom view 600 of the key assembly 500. The housing 1 may be provided with a hollow core 550. The hollow core 550 may be a space for accommodating the plunger 2. At least one vertical notch 660 may be provided on an inner surface of the housing 1. The plunger 2 may include at least one vertical bar 662 corresponding to the vertical notch 660, such that the vertical notch 660 may constrain a movement of the vertical bar 662 and thereby constrain the movement of the plunger 2 to a vertical axis. The vertical notch 660 may guide the movement of the plunger 2 to being at least substantially vertical. In other words, the vertical notch 660 may be a gliding shaft. One of the inner sides of the housing 1 may be provided with a sliding groove 552. The sliding groove 552 may include a space for the sound producing member 3 to slide upward and downward for a predetermined distance within the sliding groove 552.

Figure 7:
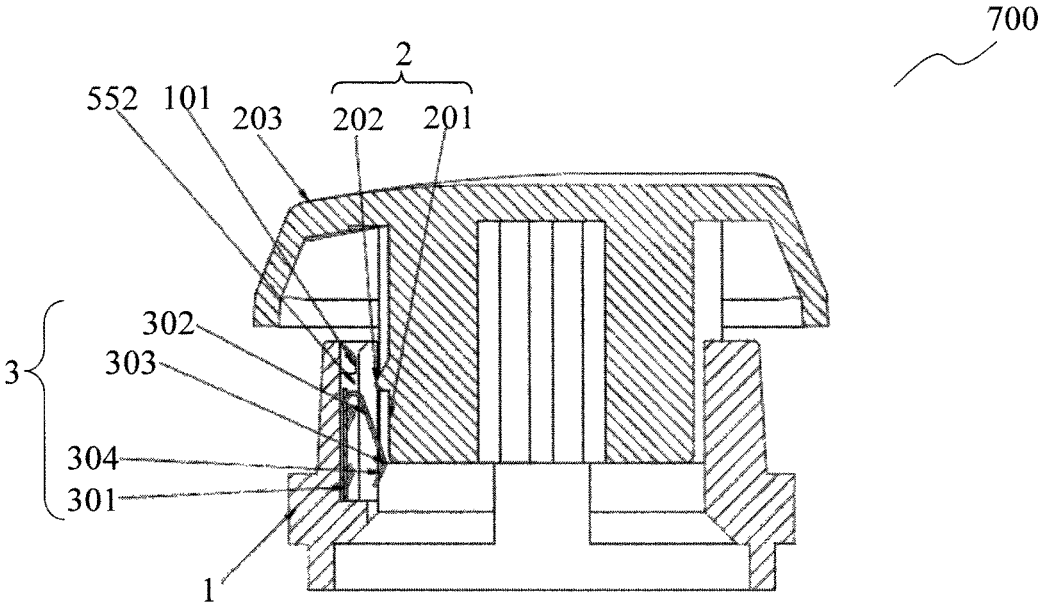
FIG. 7 shows a cross-sectional view of the key assembly of FIG. 6, viewed from the plane A-A.

FIG. 7 shows a cross-sectional view 700 of the key assembly 500, viewed from the plane A-A of FIG. 6. In the cross-sectional view 700, it can be seen that the sound producing member 3 may be provided within the housing 1. A top end of the sliding groove 552 may be terminated with a contact surface 101. The contact surface 101 may be provided at the upper portion of the inner side of the sliding groove 552. The contact surface 101 may be flat or may extend into the sliding groove 552. For example, the contact surface 101 may be a protruding feature, in other words, the contact surface 101 may have a protruding surface. The contact surface 101 may also be any one of a convex surface, a concave surface, an at least substantially flat surface or an uneven surface. The contact surface 101 may also include a protrusion with the shape of a triangle or a pyramid.

The sound producing member 3 may be disposed at a middle portion of the inner side of the sliding groove 552. The sound producing member 3 may be vertically displaceable along the sliding groove 552. The sliding groove 552 may be configured to guide the sound producing member 3 to displace at least substantially vertically. The sound producing member 3 may include a main body 301. The main body 301 may be arranged in the sliding groove 552. The sound producing member 3 may further include a connecting portion 302, an abutting portion 303 and an edge portion 304. The main body 301 may be connected to a first end of the connecting portion 302. The connecting portion 302 may be positioned at an acute angle from the main body 301. In other words, the main body 301 may bend inward, i.e. towards the plunger 2, to extend to the connecting portion 302. The connecting portion 302 may bend obliquely downward and may extend to an abutting portion 303. A second end of the connecting portion 302 may be connected to the abutting portion 303, the second end opposing the first end. The abutting portion 303 may bend outward, i.e. away from the plunger 2, to extend to an edge portion 304. The abutting portion 303 may be connected to the edge portion 304. The abutting portion 303 may be a connecting point between the connecting portion 303 and the edge portion 304. The abutting portion 303 may be a kink in between the connecting portion 303 and the edge portion 304. The connecting portion 302 may be deformable towards the main body 301. The sound producing member 3 may be elastic or elastically compressible and expandable. The sound producing member 3 may be a spring, such as a compression spring or a torsion spring. For example, the sound producing member 3 may be a leaf spring. The sound producing member 3 may store energy therein by having the connecting portion 302 deformed towards the main body 301. The sound producing member 3 may release the stored energy when the deformed connecting portion 302 rebounds back into its original shape. The sound producing member 3 may be slidable within a space between the housing 1 and the plunger 2, so that the sound producing member 3 may accelerate upwards when the compression energy stored in the sound producing member 3 is released. The main body 301, the connecting portion 30, the abutting portion 303 and the edge portion 304 may be formed as a contiguous structure, or may be connected to form a single structure. The sound producing member 3 may be formed by folding a ductile plate, such as a metallic plate. The sound producing member 3 may be free from any electrical contact points. The contact point for sending electrical signal may be located at the base of the housing 1 and may be activated when the plunger 2 reaches almost full travel distance and impacts the membrane layers at the base of the housing 1.

The plunger 2 may include an abutting surface 201 at a side of the plunger 2 corresponding to the sound producing member 3, for abutting and contacting the abutting portion 303. The abutting surface 201 may be used to contact the abutting portion 303 of the sound producing member 3. The connecting portion 302 may engage with the protrusion 202 of the plunger 2. The connecting portion 302 may be elongated in shape, to provide a longer contacting time with the protrusion 202, when the plunger 2 is displaced downwards. The abutting surface 201 may protrude downwards to form the protrusion 202. The protrusion 202 may be formed from a middle portion of the abutting surface 201. The protrusion 202 may also be referred herein as a protruding rib. The plunger 2 may be displaceable downwards until the protrusion 202 contacts the abutting portion 303. The plunger 2 may be displaceable through a first distance, i.e. a predetermined distance that may be the travel distance of the key assembly, while the sound producing member 3 may be displaceable through a second distance. The second distance may be shorter than the first distance. The plunger 2 may be configured to impact a membrane switch arranged under the plunger 2, when the plunger 2 is fully displaced downwards.

When the plunger 2 slides downward under an external force such as a user pressing on the key cap 203, the protrusion 202 may push the abutting portion 303 so that the connecting portion 302 may be deformed. When the plunger 2 slides past the abutting portion 303, the connecting portion 302 may rebound and may produce an upward momentum, so that the sound producing member 3 may generate an upward speed and may bump with the contact surface 101 to produce sound. The contact surface 101 may serve as a surface for the sound producing member 3 to collide or impact, so as to produce a sound. In other words, the structure of the sound producing member 3 that is engaged with the protrusion of the plunger may accelerate in the opposite direction as the motion of the plunger that compressed the sound producing member 3. In accelerating in the opposite direction, the sound producing member 3 may contact with the contact surface of the housing to produce a click sound. The contact surface 101 may be a hard surface, so that the sound of impact may be audibly loud. When the plunger 2 is pushed down, a switch positioned under the plunger 2 may be depressed or contacted to turn on the switch. The switch may be depressed or contacted directly by the plunger 2, or may be depressed or contacted by a push element under the plunger 2. The push element may include a spring element configured to push the plunger 2 back to its default position after the plunger 2 is pushed downwards. The switch may be a membrane switch including a plurality of membrane layers, wherein the switch is turned on when a top layer of the plurality of membrane layers is pushed down to contact the underlying layers. The sound may indicate to a user, the ON and OFF states of the key switch. In other words, the sound may be generated almost immediately after the key switch is ON.

Figure 8:
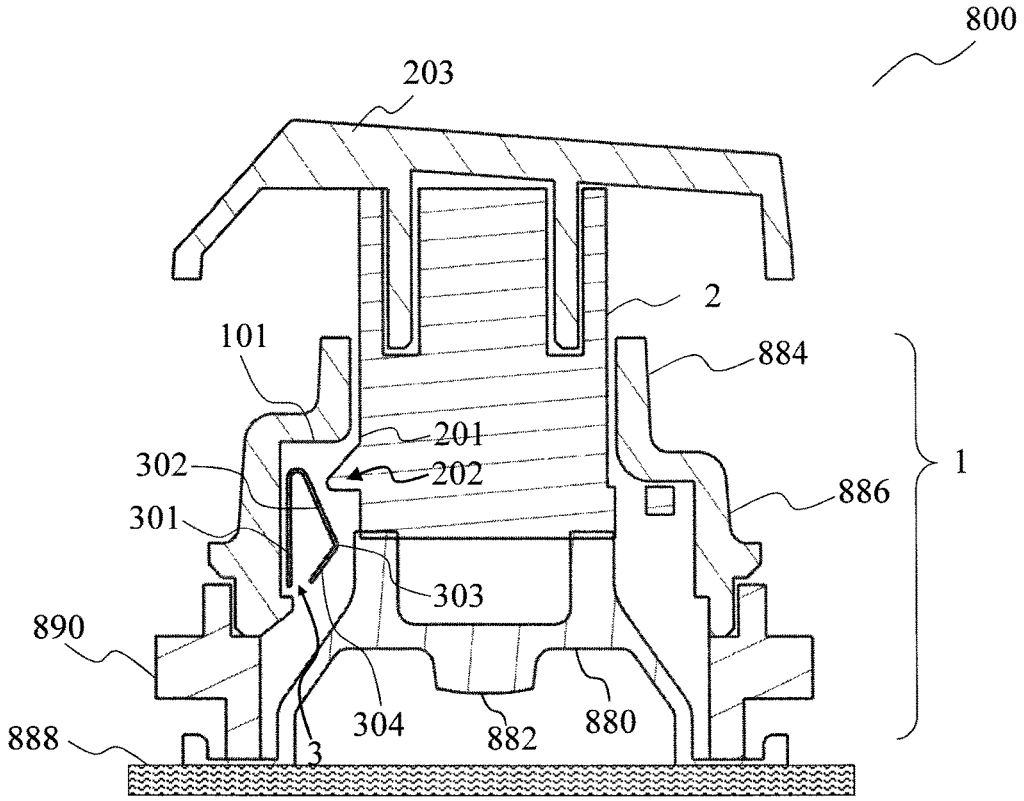
FIG. 8 shows a key assembly according to various embodiments.

FIG. 8 shows a key assembly 800 according to various embodiments. The key assembly 800 may be similar to the key assembly 500, in that it may also include a housing 1, a plunger 2 and a sound producing member 3. The key assembly 800 may also include a key cap 203. The key assembly 800 may also include a push element 880 coupled to, and positioned under the plunger 2. The push element 880 may be a rubber dome. The push element 880 may sit on top of a switch layer 888. The switch layer 888 may be a membrane switch sheet. The push element 880 may include a projection 882 that may come into contact with the switch layer 888 when the push element 880 is pushed downwards by the plunger 2. The key assembly 800 may function similarly to the key assembly 500. The plunger 2 may have a protrusion 202 formed on an abutting surface 201 of the plunger 2, the abutting surface 201 being an external surface of the plunger 2. The abutting surface 201 may face an inner surface of the housing 1. The protrusion 202 may have an at least substantially triangularly shaped cross-section. The sound producing member 3 may be shaped at least substantially like a triangle, except that the two ends of the sound producing member 3 are not connected. The gap in between the two ends of the sound producing member 3 may provide room for one end of the sound producing member 3 to be pushed towards the other end. The main body 301 may form a first side of the triangle. The connecting portion 302 may form a second side of the triangle. The edge portion 304 may form a third side of the triangle. The edge portion 304 may not come into contact with the main body 301, except when the connecting portion 302 is pushed towards the main body 301. The abutting portion 303 may be a vertex where the connecting portion 302 meets the edge portion 304. The housing 1 may extend from a bottom section 890 in contact with the push element 880, upwards to form a lower wall 886 surrounding a perimeter of the bottom portion of the plunger 2. From the lower wall 886, the housing 1 may extend inwards in the direction towards the plunger 2 to form a contact surface 101. The contact surface 101 may be at least substantially perpendicular to the lower wall 886. The contact surface 101 may extend upwards, to form an upper wall 884. The upper wall 884 may be closer to the plunger 2, than the enclosed wall 886. The upper wall 884 may extend upwards till just below the key cap 203, to prevent dust or foreign particles from entering the interior of the key assembly 800. More than one of the bottom section 890, the lower wall 886, the contact surface 101 and the upper wall 884 may be formed as a contiguous structure, or as a seamless piece. The housing 1 may be molded to form the shape including the lower wall 886, the contact surface 101 and the upper wall 884. The perimeter of the top portion of the housing, i.e. the upper wall 884 may extend towards the key cap 203 such that the key cap 203 at least partially envelops the housing 1. The perimeter of the top portion of the housing 1 may be smaller than a perimeter of a bottom portion, i.e. the lower wall 886 of the housing 1. In other words, the housing 1 may taper off to a smaller cross-section as the housing 1 extend upwards. The sensation, i.e. tactile feel that a user experiences when he presses the key cap, may be similar to the tactile feel of pressing a mechanical key switch. The tactile feel may be at least partially provided by at least one of the sound producing member 3 or the push element 880.

Unlike the key assembly 500 where a gap may exist between the housing 1 and the key cap 203 such that the plunger 2 may be visible from a side of the key assembly, the key assembly 800 may not have a gap between the housing 1 and the key cap 203 when viewed from the side. Dust may be prevented from entering the key assembly 800 from under the key cap 203, as the housing 1 and the key cap 203 may be shaped to cover the plunger 2. With dust prevented from entering the key assembly 800, the durability of the components of the key assembly may be improved. With the top opening of the gap between the housing 1 and the plunger 2 narrowed, the sound producing member 3 may be assembled into the key assembly 800 via the bottom side of the key assembly 800, instead of from the top side of the key assembly 800.

FIGS. 5 to 8 show a key release structure with audible response, according to various embodiments. The key release structure may include a lower base body, also referred herein as a housing 1, and may further include a pressing block, also referred herein as a plunger 2. The pressing block is interconnected with and onto the lower base body. The lower base body is provided with a first sliding groove configured for upward and downward sliding of the pressing block. The first sliding groove may be the hollow core 550 shown in FIG. 6. A sound producing plate, also referred herein as a sound producing member 3, is provided or disposed at the middle portion of the inner side of the first sliding groove. One of the inner sides of the lower base body is provided with a second sliding groove, for example, the sliding groove 552 shown in FIG. 6. The second sliding groove is provided with a space for the upward and downward sliding movement of the sound producing plate for a predetermined distance within the second gliding groove. The sound producing plate has a main body 301 arranged in the second sliding groove, wherein the main body 301 bends inward and extends to a connecting portion 302. The connecting portion 302 bends obliquely downward and extends to an abutting portion 303. The abutting portion 303 bends outward and extends to an edge portion 304. An abutting surface 201 for abutting and contacting the abutting portion 303 is provided at a side of the pressing block corresponding to the sound producing plate. The middle portion of the abutting surface 201 protrudes downward and forms a protruding rib, also referred herein as the protrusion 202. A protruding feature 101 is provided at the upper portion of the inner side of the first sliding groove or at the upper portion of the inner side of the second sliding groove. By providing a sound producing plate within the lower base body, when the pressing block slides downward under an external force, the protruding rib will push the abutting portion so that the connecting portion is deformed. When the pressing block slides across the top point of the connecting portion, the connecting portion rebounds and produces an upward momentum, so that the sound producing plate generates an upward speed and bumps with the protruding feature of the lower base body to produce sound, thereby determining the On and OFF states of the key. In order to prevent damage to the key or key jam/stuck caused by excessive force applied during the pressing process, the tip of the pressing block may be provided with an axially extending and protruding stopper portion, also referred herein as the key cap 203. The perimeter of the stopper portion is greater than the perimeter of the top portion of the lower base body.

The following examples pertain to further embodiments.

Example 1 is a key assembly including: a housing comprising a sliding groove on an inner surface of the housing and further comprising a contact surface above the sliding groove; a plunger at least partially fitted into the housing, the plunger comprising a protrusion; a sound producing member provided at least partially in the sliding groove, the sound producing member configured to produce sound by impacting the contact surface; wherein the sound producing member comprises a connecting portion obliquely extending to an abutting portion, the abutting portion arranged below the protrusion; wherein the plunger is displaceable downwards to deform the connecting portion using the protrusion, the deformed connecting portion being reboundable to cause the sound producing member to impact the contact surface.

In example 2, the subject matter of example 1 can optionally include that an upward momentum is generated when the deformed connecting portion rebounds.

In example 3, the subject matter of example 2 can optionally include that the sound producing member impacts the contact surface when the upward momentum is generated.

In example 4, the subject matter of any one of examples 1 to 3 can optionally include that the plunger is displaceable downwards until the protrusion contacts the abutting portion.

In example 5, the subject matter of any one of examples 1 to 4 can optionally include that the sound producing member is elastic.

In example 6, the subject matter of any one of examples 1 to 5 can optionally include that the sound producing member is a leaf spring.

In example 7, the subject matter of any one of examples 1 to 6 can optionally include that the sound producing member comprises a main body arranged in the sliding groove, wherein the connecting portion is deformable towards the main body.

In example 8, the subject matter of any one of examples 1 to 7 can optionally include that the sound producing member stores energy therein by having the connecting portion deformed In example 9, the subject matter of example 8 can optionally include that the sound producing member releases the stored energy by rebounding the deformed connecting portion.

In example 10, the subject matter of any one of examples 1 to 9 can optionally include that the sound producing member is vertically displaceable along the sliding groove.

In example 11, the subject matter of any one of examples 1 to 10 can optionally include that the sliding groove is configured to guide the sound producing member to displace at least substantially vertically.

In example 12, the subject matter of any one of examples 1 to 11 can optionally include that the housing further comprises a further sliding groove configured to guide the plunger to displace at least substantially vertically.

In example 13, the subject matter of any one of examples 1 to 12 can optionally include that the plunger is displaceable through a first distance and wherein the sound producing member is displaceable through a second distance, the second distance being shorter than the first distance.

In example 14, the subject matter of any one of examples 1 to 13 can optionally include that the contact surface protrudes towards the sliding groove.

In example 15, the subject matter of any one of examples 1 to 14 can optionally include a key cap provided over the plunger, wherein a perimeter of the key cap is greater than a perimeter of a top portion of the housing.

In example 16, the subject matter of example 15 can optionally include that the perimeter of the top portion of the housing extends towards the key cap such that the key cap at least partially envelops the housing.

In example 17, the subject matter of example 15 can optionally include that the perimeter of the top portion of the housing is small than a perimeter of a bottom portion of the housing.

In example 18, the subject matter of any one of examples 1 to 17 can optionally include that the plunger is further configured to depress a membrane switch when the plunger is fully displaced downwards.

In example 19, the subject matter of example 18 can optionally include that the sound producing member is free from direct contact with the membrane switch.

In example 20, the subject matter of any one of examples 1 to 19 can optionally include that the abutting portion bends toward the housing and extends to an edge portion.

In example 21, the subject matter of any one of examples 1 to 20 can optionally include that the plunger comprises an abutting surface at a side of the plunger, for contacting the abutting portion.

In example 22, the subject matter of example 21 can optionally include that the abutting surface protrudes downwards to form the protrusion.

Example 23 is a method for providing a key assembly, the method including: providing a housing, the housing comprising a sliding groove on an inner surface of the housing and further comprising a contact surface above the sliding groove; fitting a plunger at least partially into the housing, the plunger comprising a protrusion; providing a sound producing member at least partially in the sliding groove, the sound producing member configured to produce sound by impacting the contact surface; wherein the sound producing member comprises a connecting portion obliquely extending to an abutting portion, the abutting portion arranged below the protrusion; wherein the plunger is displaceable downwards to deform the connecting portion using the protrusion; the deformed connecting portion being reboundable to cause the sound producing member to impact the contact surface.

Example 24 is a keyboard including: a plurality of key assemblies, wherein each key assembly of the plurality of key assemblies comprises: a housing comprising a sliding groove on an inner surface of the housing and further comprising a contact surface above the sliding groove; a plunger at least partially fitted into the housing, the plunger comprising a protrusion; a sound producing member provided at least partially in the sliding groove, the sound producing member configured to produce sound by impacting the contact surface; wherein the sound producing member comprises a connecting portion obliquely extending to an abutting portion, the abutting portion arranged below the protrusion; wherein the plunger is displaceable downwards to deform the connecting portion using the protrusion; the deformed connecting portion being reboundable to cause the sound producing member to impact the contact surface.

In example 25, the subject matter of example 24 can optionally include that each key assembly of the plurality of key assemblies further comprises: a spring element under the plunger; a membrane switch under the spring element; wherein the spring element is configured to contact the membrane switch when the plunger is depressed.

Example A1 is a key release structure with audible response, including a lower base body and a pressing block, the pressing block being interconnected onto the lower base body, characterized in that: the lower base body is provided with a first sliding groove configured for upward and downward sliding movement of the pressing block, wherein a sound producing plate is provided at a middle portion of the inner side of the first sliding groove, one of the inner sides of the lower base body is provided with a second sliding groove, wherein the second sliding groove is provided with a space configured for upward and downward sliding movement of the sound producing plate for a predetermined distance within the second gliding groove, the sound producing plate comprises a main body arranged in the second sliding groove, wherein the main body bends inward and extends to a connecting portion, wherein the connecting portion bends obliquely downward and extends to an abutting portion, wherein the abutting portion bends outward and extends to an edge portion, an abutting surface for abutting and contacting the abutting portion is provided at a side of the pressing block corresponding to the sound producing plate, wherein a middle portion of the abutting surface protrudes downward to form a protruding rib, a protruding feature is provided at an upper portion of the inner side of the first sliding groove.

In example A2, the subject matter of example A1 can optionally include that that an axially extending and protruding stopper portion is provided at a tip of the pressing block, wherein the perimeter of the stopper portion is greater than the perimeter of a top portion of the lower base body.

While embodiments of the invention have been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced. It will be appreciated that common numerals, used in the relevant drawings, refer to components that serve a similar or the same purpose.

The invention claimed is:

1. A key assembly comprising:

a housing comprising a sliding groove on an inner surface of the housing and further comprising a contact surface above the sliding groove;

a plunger at least partially fitted into the housing, the plunger comprising a protrusion, wherein the plunger has a first end and a second end opposite to the first end;

a sound producing member provided at least partially in the sliding groove, the sound producing member configured to produce sound by impacting the contact surface;

a key cap coupled to the first end of the plunger;

a rubber dome provided under the second end of the plunger;

a membrane switch arranged under the rubber dome;

wherein the sound producing member comprises a connecting portion obliquely extending to an abutting portion, the abutting portion arranged below the protrusion;

wherein the plunger is displaceable downwards to deform the connecting portion using the protrusion and to collapse the rubber dome such that pressure is exerted on the membrane switch, the deformed connecting portion being reboundable;

wherein the sound producing member is vertically displaceable along the sliding groove such that upon rebounding of the deformed connecting portion, the sound producing member displaces upwards to impact the contact surface;

wherein the housing is a contiguous structure comprising a lower wall, the contact surface, and an upper wall, wherein the lower wall surrounds a bottom portion of the plunger, wherein the contact surface extends from the lower wall towards the plunger, wherein the upper wall extends from the contact surface towards the key cap; and wherein the key cap at least partially envelopes the upper wall.

2. The key assembly of claim 1, wherein an upward momentum is generated when the deformed connecting portion rebounds.

3. The key assembly of claim 2, wherein the sound producing member impacts the contact surface when the upward momentum is generated.

4. The key assembly of claim 1, wherein the plunger is displaceable downwards until the protrusion contacts the abutting portion.

5. The key assembly of claim 1, wherein the sound producing member is elastic.

6. The key assembly of claim 1, wherein the sound producing member is a leaf spring.

7. The key assembly of claim 1, wherein the sound producing member comprises a main body arranged in the sliding groove, wherein the connecting portion is deformable towards the main body.

8. The key assembly of claim 1, wherein the sound producing member stores energy therein by having the connecting portion deformed.

9. The key assembly of claim 1, wherein the sliding groove is configured to guide the sound producing member to displace at least substantially vertically.

10. The key assembly of claim 1, wherein the housing further comprises a further sliding groove configured to guide the plunger to displace at least substantially vertically.

11. The key assembly of claim 1, wherein the plunger is displaceable through a first distance and wherein the sound producing member is displaceable through a second distance, the second distance being shorter than the first distance.

12. The key assembly of claim 1, wherein the contact surface protrudes towards the sliding groove.

13. The key assembly of claim 1, wherein a perimeter of the key cap is greater than a perimeter of a top portion of the housing.

14. The key assembly of claim 1, wherein the abutting portion bends toward the housing and extends to an edge portion.

15. The key assembly of claim 1, wherein the plunger comprises an abutting surface at a side of the plunger, for contacting the abutting portion.

16. A method for providing a key assembly, the method comprising:

providing a housing, the housing comprising a sliding groove on an inner surface of the housing and further comprising a contact surface above the sliding groove;

fitting a plunger at least partially into the housing, the plunger comprising a protrusion, wherein the plunger has a first end and a second end opposite to the first end;

coupling a key cap to the first end of the plunger;

providing a rubber dome under the second end of the plunger;

arranging a membrane switch under the rubber dome;

providing a sound producing member at least partially in the sliding groove, the sound producing member configured to produce sound by impacting the contact surface;

wherein the sound producing member comprises a connecting portion obliquely extending to an abutting portion, the abutting portion arranged below the protrusion;

wherein the plunger is displaceable downwards to deform the connecting portion using the protrusion and to collapse the rubber dome such that pressure is exerted on the membrane switch;

the deformed connecting portion being reboundable;

wherein the sound producing member is vertically displaceable along the sliding groove such that upon rebounding of the deformed connecting portion, the sound producing member displaces upwards to impact the contact surface;

wherein the housing is a contiguous structure comprising a lower wall, the contact surface, and an upper wall, wherein the lower wall surrounds a bottom portion of the plunger, wherein the contact surface extends from the lower wall towards the plunger, wherein the upper wall extends from the contact surface towards the key cap; and wherein the key cap at least partially envelopes the upper wall.

17. A keyboard comprising:

a plurality of key assemblies, wherein each key assembly of the plurality of key assemblies comprises:

a housing comprising a sliding groove on an inner surface of the housing and further comprising a contact surface above the sliding groove;

a plunger at least partially fitted into the housing, the plunger comprising a protrusion, wherein the plunger has a first end and a second end opposite to the first end;

a sound producing member provided at least partially in the sliding groove, the sound producing member configured to produce sound by impacting the contact surface;

a key cap coupled to the first end of the plunger;

a rubber dome provided under the second end of the plunger;

a membrane switch arranged under the rubber dome;

wherein the sound producing member comprises a connecting portion obliquely extending to an abutting portion, the abutting portion arranged below the protrusion;

wherein the plunger is displaceable downwards to deform the connecting portion using the protrusion and to collapse the rubber dome such that pressure is exerted on the membrane switch, the deformed connecting portion being reboundable;

wherein the sound producing member is vertically displaceable along the sliding groove such that upon rebounding of the deformed connecting portion, the sound producing member displaces upwards to impact the contact surface;

wherein the housing is a contiguous structure comprising a lower wall, the contact surface, and an upper wall, wherein the lower wall surrounds a bottom portion of the plunger, wherein the contact surface extends from the lower wall towards the plunger, wherein the upper wall extends from the contact surface towards the key cap; and wherein the key cap at least partially envelopes the upper wall.

* * * * *